US011784421B2

(12) United States Patent
Tan

(10) Patent No.: US 11,784,421 B2
(45) Date of Patent: Oct. 10, 2023

(54) SELF-COUPLED WIRE CONNECTOR USING BEND SPRING SHEET AND CONDUCTOR SHEET

(71) Applicant: Dongguan Chenming Electronic Technology Co., Ltd., Dongguan (CN)

(72) Inventor: Qiang Tan, Dongguan (CN)

(73) Assignee: Dongguan Chenming Electronic Technology Co., Ltd., Dongguan (CN)

( * ) Notice: Subject to any disclaimer, the term of this patent is extended or adjusted under 35 U.S.C. 154(b) by 0 days.

(21) Appl. No.: 17/837,061

(22) Filed: Jun. 10, 2022

(65) Prior Publication Data

US 2022/0302608 A1 Sep. 22, 2022

(30) Foreign Application Priority Data

May 9, 2022 (CN) ..... 202210501941.8

(51) Int. Cl.
*H01R 4/48* (2006.01)
*H01R 11/09* (2006.01)

(52) U.S. Cl.
CPC ..... *H01R 4/4818* (2013.01); *H01R 11/09* (2013.01)

(58) Field of Classification Search
CPC ..... H01R 4/4818; H01R 11/09; H01R 13/40; H01R 13/02; H01R 13/639
See application file for complete search history.

(56) References Cited

U.S. PATENT DOCUMENTS

| | | | | | |
|---|---|---|---|---|---|
| 4,397,514 | A * | 8/1983 | Durand | H01R 4/4818 | 439/830 |
| 5,975,940 | A * | 11/1999 | Hartmann | H01R 4/4818 | 439/441 |
| 6,746,286 | B2 * | 6/2004 | Blaha | H01R 4/4809 | 439/787 |
| 7,507,106 | B2 * | 3/2009 | Keswani | H01R 4/4818 | 439/439 |
| 8,187,023 | B1 * | 5/2012 | Chen | H01R 4/22 | 439/441 |
| 9,859,649 | B2 * | 1/2018 | Konietzko | H01R 13/506 | |
| 11,145,997 | B1 * | 10/2021 | Chen | H01R 4/4818 | |
| 11,201,417 | B1 * | 12/2021 | Chen | H01R 4/4836 | |
| 11,424,557 | B2 * | 8/2022 | Chen | H01R 4/4818 | |
| 11,539,147 | B2 * | 12/2022 | Tseng | H01R 4/4845 | |
| 2008/0171464 | A1 | 7/2008 | Keeven | | |
| 2015/0090488 | A1 | 4/2015 | Laverdiere et al. | | |
| 2019/0199011 | A1 * | 6/2019 | Koellmann | H01R 4/4818 | |
| 2020/0350703 | A1 | 11/2020 | Niu | | |
| 2022/0037809 | A1 * | 2/2022 | Tseng | H01R 4/4845 | |

* cited by examiner

*Primary Examiner* — Briggitte R. Hammond
(74) *Attorney, Agent, or Firm* — Jose Cherson Weissbrot

(57) ABSTRACT

The present disclosure relates to the technical field of electrical connection, in particular to a self-coupled wire connector using a bend spring sheet and conductor sheet, including a main body, a spring sheet and a conductor sheet; a coupling space for accommodating the spring sheet and the conductor sheet is formed inside the main body; a wire plugging hole passing through the coupling space is formed in the main body; the spring sheet and the conductor sheet are assembled in the coupling space, and are kept in a self-coupling state through the coupling space; a wire presses against the spring sheet and the conductor sheet to force the spring sheet and the conductor sheet to be self-coupled.

20 Claims, 7 Drawing Sheets

SELF-COUPLED WIRE CONNECTOR USING BEND SPRING SHEET AND CONDUCTOR SHEET

TECHNICAL FIELD

The present disclosure relates to the technical field of electrical connection, in particular to a self-coupled wire connector using a bend spring sheet and conductor sheet.

BACKGROUND

Existing plug-in connectors are divided into connectors with shell restraint structures and connectors with hardware restraint structures.

The plug-in connector with the shell restraint structure is composed of a V-shaped spring sheet and a conductor sheet that is not connected to the spring sheet. The V-shaped spring sheet and the conductor sheet are restrained in specific structures, restrained by a main body of the connector, at different positions. Before a wire is plugged in, one end of the V-shaped spring sheet deforms to press the wire on the conductor sheet; and at this time, since the spring sheet has a simple structure, which does not consider effective decomposition of a pressure, the other end of the V-shaped spring sheet may also deform due to a requirement for direct transmission of a force. However, the V-shaped spring sheet is restrained in the specific structure of the main body, so that the deformation is prevented, and a pressure on the wire is generated, thus realizing connection and restraining functions. However, the structure restrained by the main body bears all forces generated by the deformation of the spring sheet, so that an extremely high requirement is put forward to a material of the main body. Particularly, a high temperature generated after electrification may cause the main body to deform, so the main body loses the effective connection effect. An example of such a structure has been disclosed in U.S. Pat. No. 6,746,286B2.

In another kind of hardware-restrained connector, a conductor sheet is fixed on a spring sheet by riveting, welding, or other connection methods. The spring sheet is mounted in a free space in a main body. Although internal decomposition of a pressure after a wire is plugged is achieved by a spring sheet and conductor sheet connection body, the spring sheet can only be designed to have a simple structure due to a requirement for an implementation space of riveting or welding, so that the pressure cannot be effectively decomposed inside. In addition, the conductor sheet has been fixed at a specific position of the spring sheet in advance, so that a contact area after a wire is plugged can only be determined according to the pressure, which increases the requirement for a manufacturing material, which increases the cost. Furthermore, due to the reliability of riveting or welding implementation and an extremely high requirement of the pressure after a wire is plugged for the firmness of a riveted or welded joint, the reliability of wire connection will be greatly reduced once the riveted and welded joints are disconnected by the pressure. At the same time, due to the implementation requirements such as riveting and welding, the process for machining this kind of connector is complicated, and manufacturing equipment is more complicated, which leads to an increase in cost. An example of this structure has been disclosed in European Patent No. 1855353A2.

SUMMARY

In order to overcome the above deficiencies, the present disclosure aims to provide a technical solution capable of solving the above problems.

A self-coupled wire connector using a bend spring sheet and conductor sheet includes a main body, a spring sheet and a conductor sheet; a coupling space for accommodating the spring sheet and the conductor sheet is formed inside the main body; a wire plugging hole passing through the coupling space is formed in the main body; the spring sheet and the conductor sheet are assembled in the coupling space, and are kept in a self-coupling state through the coupling space;

the spring sheet is provided with one or more wire pressing units; each wire pressing unit includes a middle wire pressing portion and two deformable portions respectively located on two sides of the wire pressing portion; the wire pressing portion and the deformable portions are integrated at upper parts; the deformable portions resist against the inside of the coupling space and correspond to two sides of the wire plugging hole, so that a lower part of the wire pressing portion moves between the wire plugging holes; when a plurality of wire pressing units are provided, tear structures for avoiding mutual interference are arranged between the plurality of wire pressing units;

the conductor sheet is designed to be a bend structure resisting against the deformable portions; a tooth-shaped structure passing through a space between the two deformable portions is formed at an end part of the conductor sheet resisting against the deformable portions; and the tooth-shaped structure extends deep into the wire plugging hole, so that the tooth-shaped structure and the wire pressing portion cooperate with each other to form a coupling gap for clamping a wire end.

Preferably, an upper first bending angle, a middle second bending angle and a lower third bending angle are arranged on each deformable portion; and the first bending angle, the second bending angle and the third bending angle jointly form the deformable portion of a wavy structure.

Preferably, when a plurality of wire pressing units are provided, the various wire pressing units may be horizontally connected or perpendicularly connected.

Preferably, when the wire pressing units are horizontally connected, adjacent wire pressing units are in planar connection through the deformable portions located below the second bending angles, thus forming one spring sheet of a horizontally connected structure; the deformable portions, located above the second bending angles, between adjacent wire pressing units are separated from each other, so as to avoid mutual interference between the plurality of wire pressing units; and in the spring sheet, a first assembling gap is reserved between planes formed after the third bending angles of the various deformable portions are bent, and is used for mounting the conductor sheet.

Preferably, when the wire pressing units are horizontally connected, connection surfaces for integrally connecting the deformable portions of all the wire pressing units are formed on the deformable portions located above the third bending angles; and a space for separation is provided between the connection surfaces and the wire pressing portions.

Preferably, when the wire pressing units are horizontally connected, the conductor sheet is bent along the middle part, and a second assembling gap is reserved between the bent planes of the conductor sheet and is used for mounting the spring sheet; two ends of the bend conductor sheet are located on the same side; and the tooth-shaped structure is formed at one end of the conductor sheet.

Preferably, when the wire pressing units are horizontally connected, adjacent wire pressing units are in planar connection through the deformable portions located below the second bending angles, thus forming one spring sheet of a horizontally connected structure; the deformable portions, located above the second bending angles, between the adjacent wire pressing units are separated from each other to avoid mutual interference between the plurality of wire pressing units; in the spring sheet, a first assembling gap is reserved between planes formed after the third bending angles of the various deformable portions are bent, and is used for mounting the conductor sheet; connection surfaces for integrally connecting the deformable portions of all the wire pressing units are formed on the deformable portions located above the third bending angles; a space for separation is provided between the connection surfaces and the wire pressing portions; the conductor sheet is bent along the middle part, and a second assembling gap is reserved between the bent planes of the conductor sheet and is used for mounting the spring sheet; two ends of the bent conductor sheet are located on the same side; the tooth-shaped structure is formed at one end of the conductor sheet;

one end of the conductor sheet corresponding to the tooth-shaped structure is plugged into the first assembling gap, and the number of teeth on the tooth-shaped structure corresponds to the number of the wire pressing units; the tooth-shaped structure extends deep into the space for separation between the connection surfaces and the wire pressing portions; each tooth on the tooth-shaped structure is restrained between the two deformable portions of the corresponding wire pressing unit; and the connection surface is plugged into the second assembling gap, so that a structure for mutual hooking cooperation is formed between the conductor sheet and the spring sheet.

Preferably, when the wire pressing units are perpendicularly connected, the third bending angles of the deformable portions are bent to form a perpendicularly connected surface; two perpendicularly adjacent wire pressing units are connected through the perpendicularly connected surface to form one spring sheet of a perpendicularly connected structure, and a third assembling gap is reserved between planes formed after the third bending angles of the deformable portions of two adjacent wire pressing units are bent; a space for separation is provided between the wire pressing portions of two adjacent wire pressing units and is used for mounting the conductor sheet.

Preferably, when the wire pressing units are perpendicularly connected, the perpendicularly connected surfaces of the two deformable portions on two sides of the wire pressing portion respectively extend towards one side of the wire pressing portion to form one arc bulge portion; and each arc bulge portion is inwards bent to jointly form a supporting surface of an inner bend angle of the conductor sheet.

Preferably, when the wire pressing units are perpendicularly connected, the conductor sheet is bent along the middle part, and a fourth assembling gap cooperating with the supporting surface is reserved between the bent planes of the conductor sheet; two ends of the bent conductor sheet are located on the same side; and the tooth-shaped structure is formed at two ends of the conductor sheet.

Preferably, when the wire pressing units are perpendicularly connected, the third bending angles of the deformable portions are bent to form a perpendicularly connected surface; two perpendicularly adjacent wire pressing units are connected through the perpendicularly connected surface to form one spring sheet of a perpendicularly connected structure, and a third assembling gap is reserved between planes formed after the third bending angles of the deformable portions of two adjacent wire pressing units are bent; a space for separation is provided between the wire pressing portions of two adjacent wire pressing units and is used for mounting the conductor sheet; the perpendicularly connected surfaces of the two deformable portions on two sides of the wire pressing portion respectively extend towards one side of the wire pressing portion to form one are bulge portion; each arc bulge portion is inwards bent to jointly form a supporting surface of an inner bend angle of the conductor sheet; the conductor sheet is bent along the middle part, and a fourth assembling gap cooperating with the supporting surface is reserved between the bent planes of the conductor sheet; two ends of the bent conductor sheet are located on the same side; the tooth-shaped structure is formed at two ends of the conductor sheet;

the two ends of the conductor sheet are plugged into the third assembling gap, and the two ends of the conductor sheet respectively resist against the third bending angles of two adjacent wire pressing units; the number of teeth on the tooth-shaped structure corresponds to the number of the wire pressing units; the tooth-shaped structure extends deep into the space between two adjacent wire pressing portions; each tooth on the tooth-shaped structure is restrained between the two perpendicularly connected surfaces of the two adjacent wire pressing units; at the same time, the supporting surface extends deep into the fourth assembling gap; and the supporting surface resists against an inner edged surface of the conductor sheet.

Preferably, the main body includes an outer shell and an inner plug plugged to the outer shell; a coupling space is correspondingly formed between the outer shell and the inner plug; and the wire plugging hole penetrates through the inner plug and extends into the outer shell.

Preferably, the outer shell is of uni-directional opened structure, and a clamping slot is formed in a side wall of the outer shell.

Preferably, a clamping block is arranged on a side wall of the inner plug; the inner plug is divided into two parts of structures; one part is a wide structure; and the other part is a narrow structure.

Preferably, the outer shell is of a uni-directional opened structure; a clamping slot is formed in a side wall of the outer shell; the inner plug is divided into two parts of structures; one part is a wide structure, and the other part is a narrow structure; a clamping block is arranged on a side wall of the narrow structure of the inner plug; the narrow structure of the inner plug extends deep into the outer shell to limit positions of the spring sheet and the conductor sheet; the wide structure cooperates with an outer frame of the outer shell to limit an extending distance of the narrow structure; and the clamping block and the clamping slot achieve clamping and fixing to prevent the inner plug from falling off.

Preferably, the wire plugging hole has a guide positioning hole corresponding to the outer shell; the guide positioning hole is communicated to the coupling space; the number of the guide positioning holes is set according to the number of the wire pressing units; first isolation structures are reserved between all the guide positioning holes; the first isolation structures isolate the guide positioning holes, so that each of the plurality of guide positioning holes forms a structure that limits a swing scope of a wire in the guide positioning hole.

Preferably, the wire plugging hole has a square wire guide hole corresponding to the inner plug; the square wire guide hole is of a run-through structure, and the square wire guide hole is communicated to the coupling space; the number of the square wire guide holes is set according to the number of the wire pressing units; second isolation structures are arranged between all the square wire guide holes; and the second isolation structures isolate the square wire guide holes from each other.

Preferably, the main body includes an outer shell and an inner plug plugged to the outer shell; a coupling space is correspondingly formed between the outer shell and the inner plug; the wire plugging hole penetrates through the inner plug and extends into the outer shell; the wire plugging hole has a guide positioning hole corresponding to the outer shell; the wire plugging hole has a square wire guide hole corresponding to the inner plug; the guide positioning hole and the square wire guide hole are both communicated with the coupling space; the guide positioning hole corresponds to the square wire guide hole; a first wavy structure matched with the shape of the spring sheet is designed at an edge, corresponding to the guide positioning hole, in the outer shell; and the first wavy structure corresponds to the first bending angle, the second bending angle and the third bending angle of the deformable portion in each wire pressing unit of the spring sheet.

Preferably, the main body includes an outer shell and an inner plug plugged to the outer shell; a coupling space is correspondingly formed between the outer shell and the inner plug; the wire plugging hole penetrates through the inner plug and extends into the outer shell; the wire plugging hole has a guide positioning hole corresponding to the outer shell; the wire plugging hole has a square wire guide hole corresponding to the inner plug part; the guide positioning hole and the square wire guide hole are both communicated with the coupling space; the guide positioning hole corresponds to the square wire guide hole; a second wavy structure matched with the shapes of the spring sheet and the conductor sheet is designed at a portion of the inner plug that extends deep into the outer shell; the second wavy structure corresponds to the first bending angle, the second bending angle and the third bending angle of the deformable portion in each wire pressing unit of the spring sheet; and the second wavy structure also corresponds to the bend structure of the conductor sheet.

Preferably, the main body includes an outer shell and an inner plug plugged to the outer shell; a first wavy structure matched with the shape of the spring sheet is designed at an edge, corresponding to a guide positioning hole, in the outer shell; a second wavy structure matched with the shapes of the spring sheet and the conductor sheet is designed at a portion of the inner plug that extends deep into the outer shell; and a coupling space for accommodating the spring sheet and the conductor sheet is formed between the first wavy structure and the second wavy structure.

Compared with the existing art, the present disclosure has the following beneficial effects.

The wire connector is mainly set to have three structures: the main body, the spring sheet and the conductor sheet, which cooperate with each other in a coupled manner; the spring sheet and the conductor sheet are structurally restrained; due to the structural design of the coupling space of the main body, the spring sheet and the conductor sheet are gathered and cover the wire plugging hole passing through the coupling space; after a wire is plugged, the wire presses against the spring sheet and the conductor sheet to force the spring sheet and the conductor sheet to be self-coupled, thus improving the cooperation flexibility of the spring sheet and the conductor sheet, so that the wire can be plugged into the wire connector more reasonably, which can ensure a firm connection between the wire and the wire connector and can also ensure that the conductor sheet and the wire achieve a better conducting effect; and furthermore, by this design, the riveting or welding procedure is eliminated, so that the consumption of cost and time in the production and manufacturing process is reduced.

For the gathering and coverage structural stability of the spring sheet and the conductor sheet, a tooth-shaped structure passing through a space between the two deformable portions is formed at an end part of the conductor sheet resisting against the deformable portions, and the tooth-shaped structure extends deep into the wire plugging hole, so that the tooth-shaped structure and the wire pressing portion cooperate with each other to form a coupling gap for clamping a wire end. In this structural design, the mutual restriction between spring sheet and the conductor sheet is further improved, so that the self-coupling effect between the spring sheet and the conductor sheet is further enhanced.

The deformable portion is configured to be a bend structure. The deformable portions form a plurality of bend structures. When the wire pressing portions press a wire, reasonable decomposition of a force can be achieved through the plurality of bend structures to achieve a better elastic pressing effect, so that the spring sheet can have the same supporting force under a smaller volume, thus reducing the volume of the wire connector; and furthermore, the reasonable decomposition of a force avoids a decrease in a local stress caused by acceleration of metal fatigue and prolongs the service life of the spring sheet.

A plurality of wire plugging holes are isolated from each other. Specifically, first isolation structures are arranged at portions between the guide positioning holes corresponding to the outer shell, and second isolation structures are arranged at portions between the square wire guide holes corresponding to the inner plug, so that a space where a wire moves in the wire plugging hole is restrained, and the instability of contact caused by wire swinging is reduced.

The additional aspects and advantages of the prevent disclosure will be provided in the following descriptions, part of which will become apparent from the following descriptions or be learned through the practice of the prevent disclosure.

BRIEF DESCRIPTION OF THE DRAWINGS

In order to describe the embodiments of the disclosure or the technical solutions in the existing art more clearly, drawings required to be used in the embodiments or the illustration of the existing art will be briefly introduced below. Obviously, the drawings in the illustration below are only some embodiments of the disclosure. Those ordinarily skilled in the art also can acquire other drawings according to the provided drawings without doing creative work.

Figure 1:
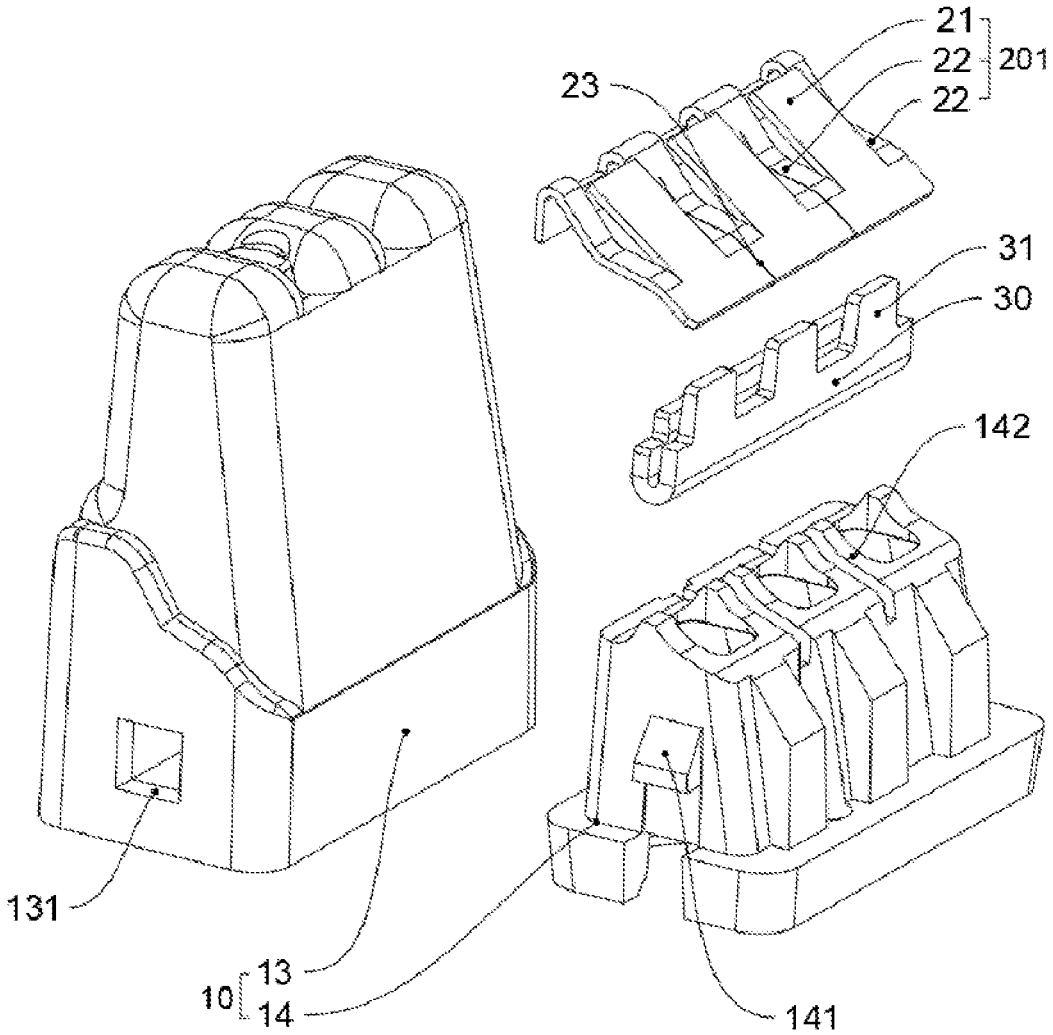
FIG. 1 is an exploded structural diagram of Embodiment 1 of the present disclosure.
Figure 2:
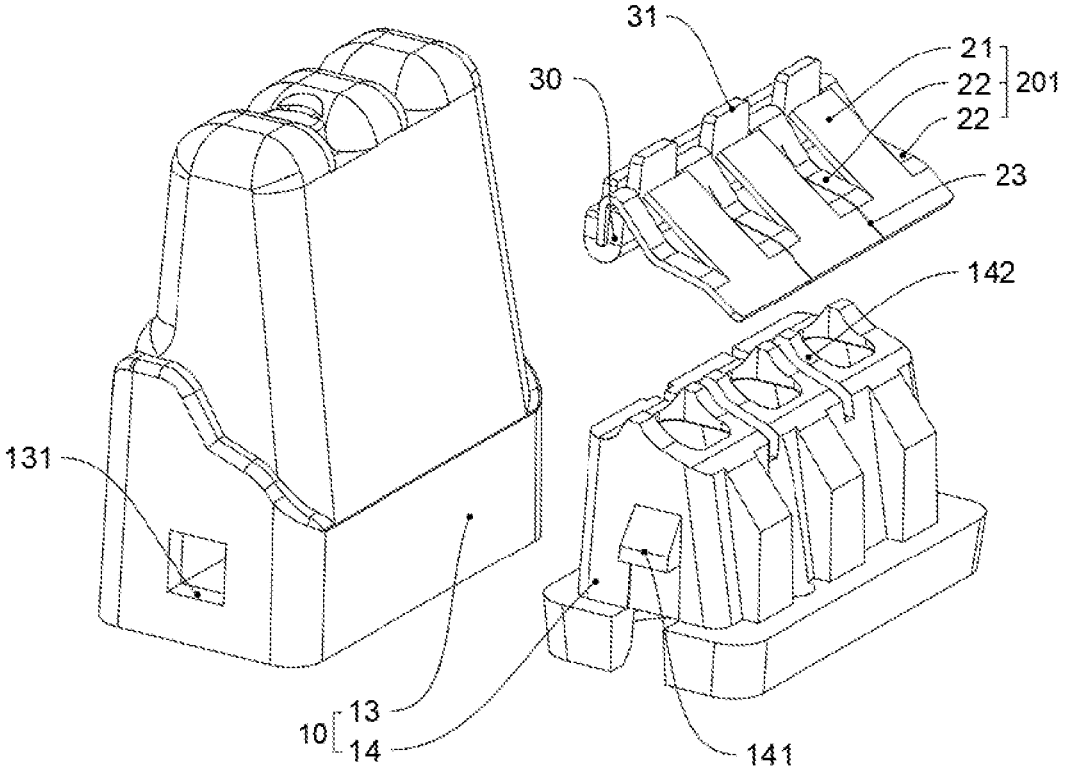
FIG. 2 is a schematic structural diagram after a spring sheet and a conductor sheet are combined in FIG. 1 of the present disclosure.
Figure 3:
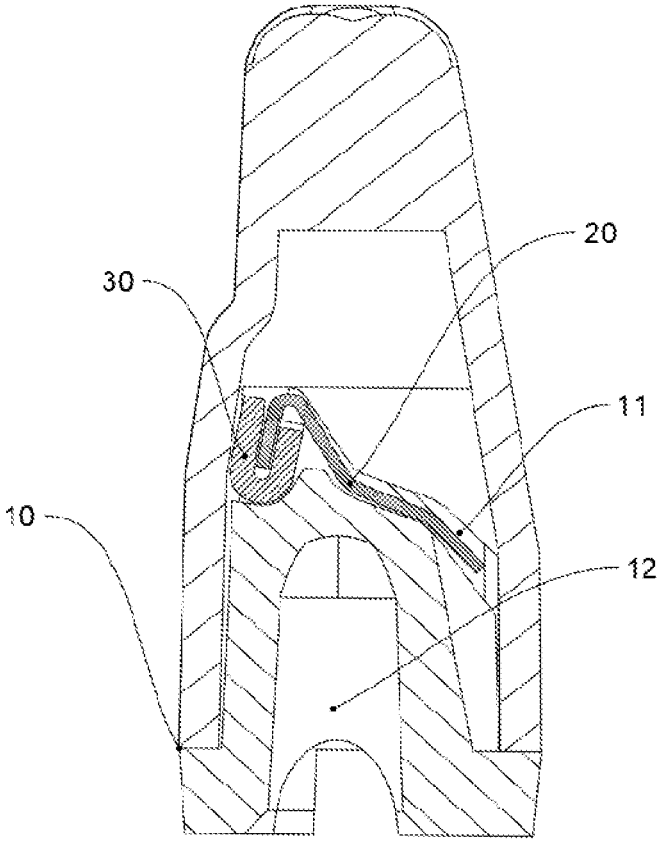
FIG. 3 is a cross-sectional schematic structural diagram of Embodiment 1 of the present disclosure.
Figure 4:
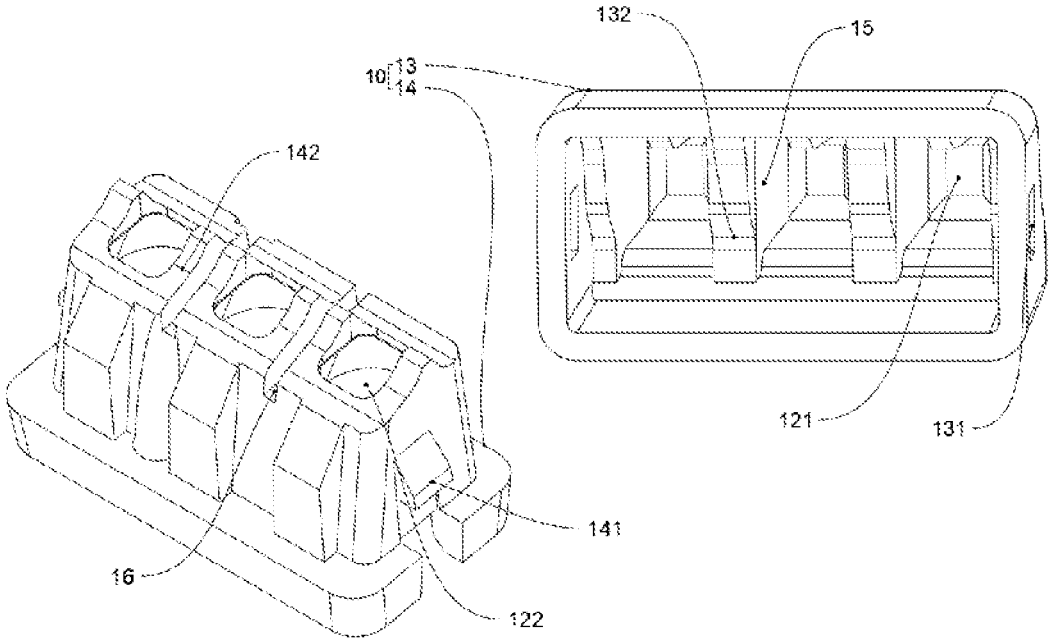
FIG. 4 is a schematic structural diagram of removal of a main body in Embodiment 1 of the present disclosure.

Reference signs and names in the drawings are as follows: 10: main body; 20: spring sheet; 30: conductor sheet; 11: coupling space; 12: wire plugging hole; 13: outer shell; 14: inner plug; 15: first isolation structure; 16: second isolation structure; 21: wire pressing portion; 22: deformable portion; 23: tear structure; 24: first assembling gap; 25: third assembling gap; 26: supporting surface; 31: tooth-shaped structure; 34: second assembling gap; 35: fourth assembling gap; 121: guide positioning hole; 122: square wire guide hole; 131: clamping slot; 132: first wavy structure; 141: clamping block; 142: second wavy structure; 201: wire pressing unit; 221: first bending angle; 222: second bending angle; 223: third bending angle.

DETAILED DESCRIPTION OF THE EMBODIMENTS

The technical solutions in the embodiments of the present disclosure will be clearly and completely described below. Apparently, the described embodiments are only a part of the embodiments of the present disclosure, rather than all the embodiments. Based on the embodiments in the present disclosure, all other embodiments obtained by those of ordinary skill in the art without creative work shall fall within the protection scope of the present disclosure.

Referring to FIG. 1 to FIG. 10, in the embodiment of the present disclosure, a self-coupled wire connector using a bend spring sheet and conductor sheet includes a main body 10, a spring sheet 20 and a conductor sheet 30. A coupling space 11 for accommodating the spring sheet 20 and the conductor sheet 30 is formed inside the main body 10; a wire plugging hole 12 passing through the coupling space 11 is formed in the main body 10; and the spring sheet 20 and the conductor sheet 30 are assembled in the coupling space 11, and are kept in a self-coupling state through the coupling space 11.

The spring sheet 20 is provided with one or more wire pressing units 201; each wire pressing unit 201 includes a middle wire pressing portion 21 and two deformable portions 22 respectively located on two sides of the wire pressing portion 21; the wire pressing portion 21 and the deformable portions 22 are integrated at upper parts; the deformable portions 22 resist against the inside of the coupling space 11 and correspond to two sides of the wire plugging hole 12, so that a lower part of the wire pressing portion 21 moves between the wire plugging holes 12; and when a plurality of wire pressing units 201 are provided, tear structures 23 for avoiding mutual interference are arranged between the plurality of wire pressing units 201.

The conductor sheet 30 is designed to be a bend structure resisting against the deformable portions 22; a tooth-shaped structure 31 passing through a space between the two deformable portions 22 is formed at an end part of the conductor sheet 30 resisting against the deformable portions 22; and the tooth-shaped structure 31 extends deep into the wire plugging hole 12, so that the tooth-shaped structure 31 and the wire pressing portion 21 cooperate with each other to form a coupling gap for clamping a wire end.

In the technical solution of the present disclosure, the wire connector is mainly set to have three structures: the main body 10, the spring sheet 20 and the conductor sheet 30, which cooperate with each other in a coupled manner; the spring sheet 20 and the conductor sheet 30 are structurally restrained; due to the structural design of the coupling space 11 of the main body 10, the spring sheet 20 and the conductor sheet 30 are gathered and cover the wire plugging hole 12 passing through the coupling space 11; after a wire is plugged, the wire presses against the spring sheet 20 and the conductor sheet 30 to force the spring sheet 20 and the conductor sheet 30 to be self-coupled, thus improving the cooperation flexibility of the spring sheet 20 and the conductor sheet 30, so that the wire can be plugged into the wire connector more reasonably, which can ensure a firm connection between the wire and the wire connector and can also ensure that the conductor sheet 30 and the wire achieve a better conducting effect; and furthermore, by this design, the riveting or welding procedure is eliminated, so that the consumption of cost and time in the production and manufacturing process is reduced.

For the gathering and coverage structural stability of the spring sheet 20 and the conductor sheet 30, a tooth-shaped structure 31 passing through a space between the two deformable portions 22 is formed at an end part of the conductor sheet 30 resisting against the deformable portions 22, and the tooth-shaped structure 31 extends deep into the wire plugging hole 12, so that the tooth-shaped structure 31 and the wire pressing portion 21 cooperate with each other to form a coupling gap for clamping a wire end. In this structural design, the mutual restriction between spring sheet 20 and the conductor sheet 30 is further improved, so that the self-coupling effect between the spring sheet 20 and the conductor sheet 30 is further enhanced.

Figure 5:
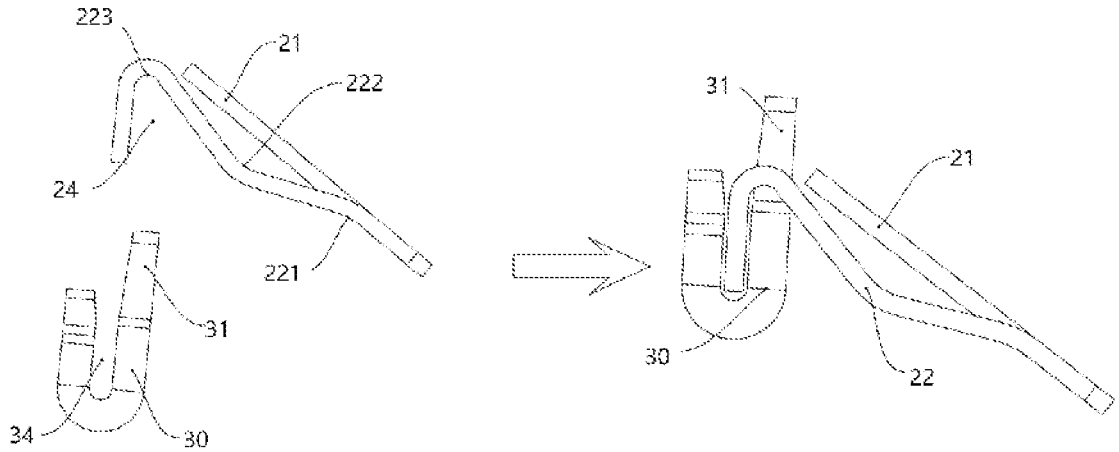
FIG. 5 is a schematic diagram of assembling of a spring sheet and a conductor sheet in FIG. 1 of the present disclosure.
Figure 6:
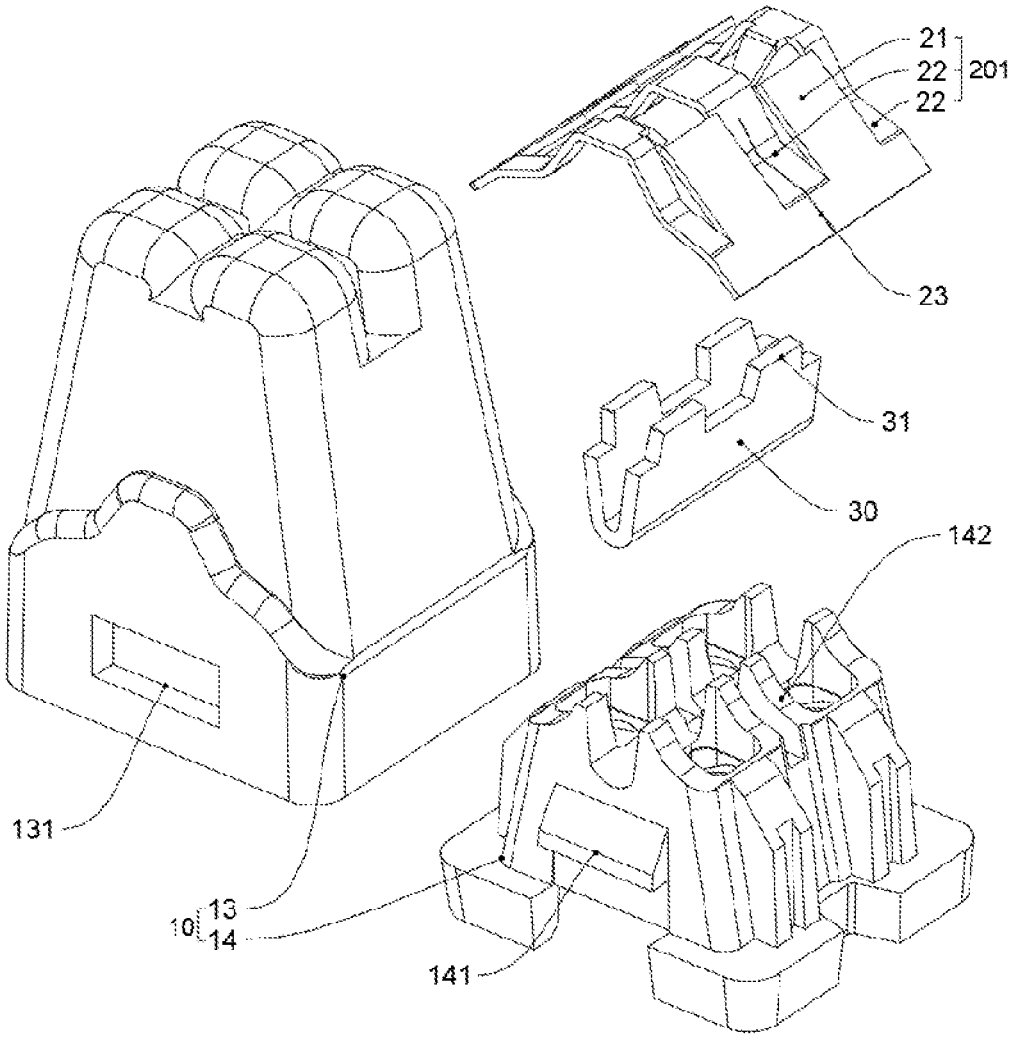
FIG. 6 is an exploded structural diagram of Embodiment 2 of the present disclosure.
Figure 7:
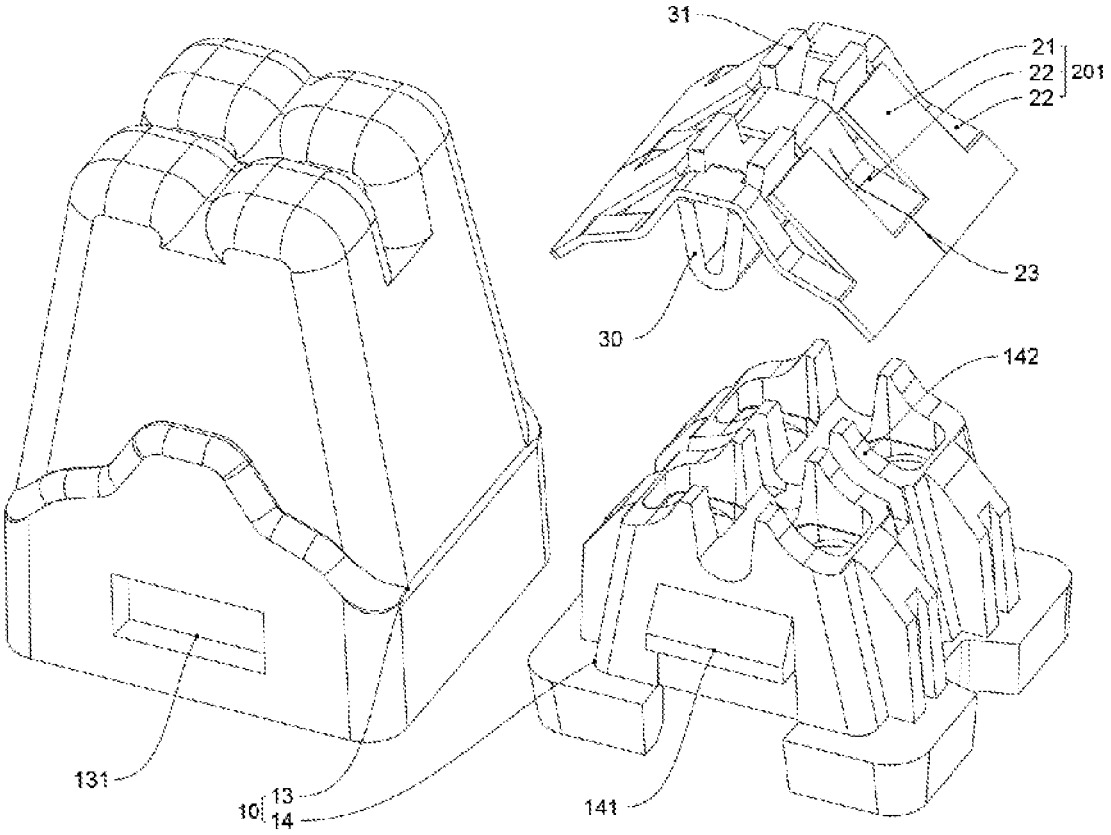
FIG. 7 is a schematic structural diagram after a spring sheet and a conductor sheet are combined in FIG. 6 of the present disclosure.
Figure 8:
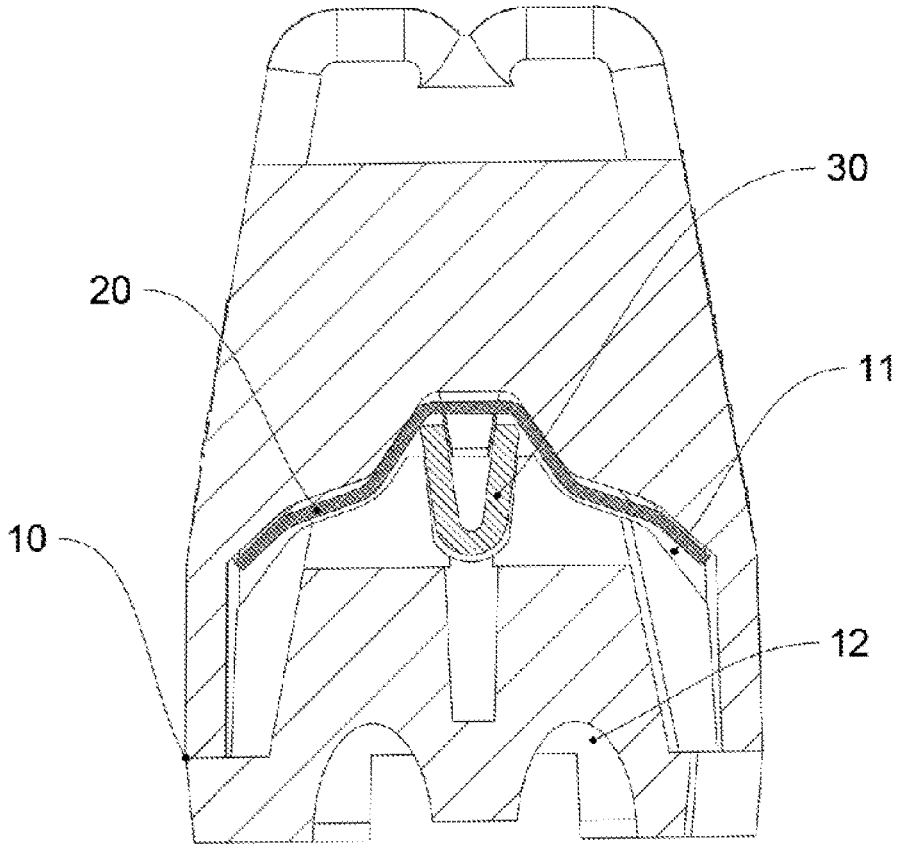
FIG. 8 is a cross-sectional schematic structural diagram of Embodiment 2 of the present disclosure.
Figure 9:
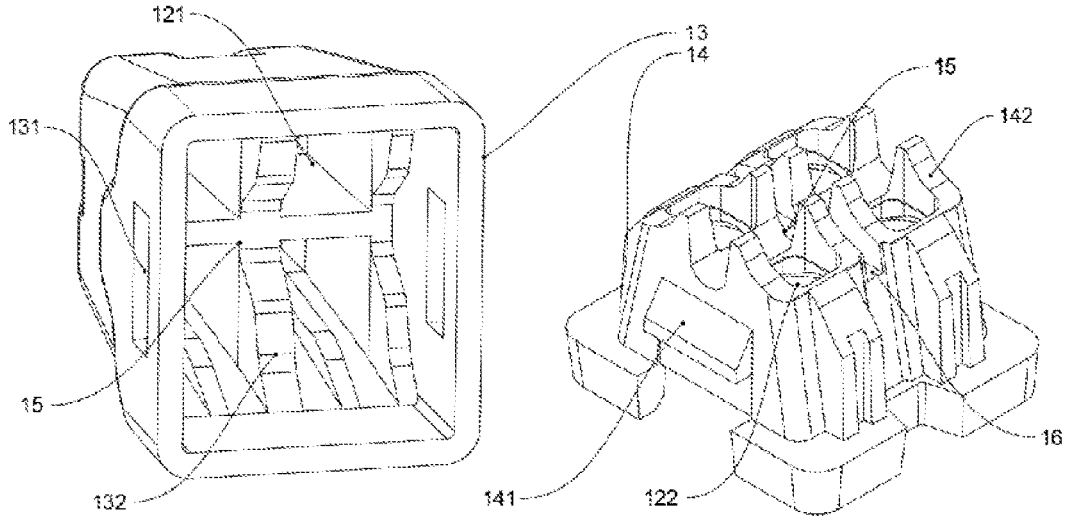
FIG. 9 is a schematic structural diagram of removal of a main body in Embodiment 2 of the present disclosure.
Figure 10:
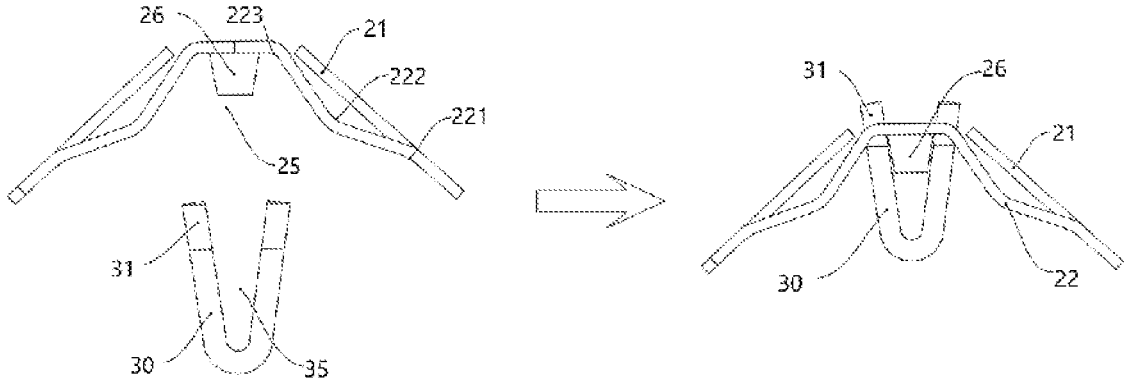
FIG. 10 is a schematic diagram of assembling of a spring sheet and a conductor sheet in FIG. 2 of the present disclosure.

Referring to FIG. 5 and FIG. 10, an upper first bending angle 221, a middle second bending angle 222 and a lower third bending angle 223 are arranged on each deformable portion 22; and the first bending angle 221, the second bending angle 222 and the third bending angle 223 jointly form the deformable portion 22 of a wavy structure. By this design, the deformable portion 22 has three bending angles. During pressing of a wire, the wire pressing portion 21 deforms to force the first bending angle 221 to deform towards a gathering direction; when the first bending angle 221 deforms, the second bending angle 222 is forced to deform towards an expanding direction; and when the second bending angle 222 deforms, the third bending angle 223 is forced to deform towards the gathering direction, so that a force can be reasonably decomposed.

Referring to FIG. 1 to FIG. 4 and FIG. 6 to FIG. 9, the main body 10 includes an outer shell 13 and an inner plug 14 plugged to the outer shell 13. A coupling space 11 is correspondingly formed between the outer shell 13 and the inner plug 14. The wire plugging hole 12 penetrates through the inner plug 14 and extends into the outer shell 13.

For a connected structure of the outer shell 13 and the inner plug 14, the outer shell 13 is configured to be a uni-directional opened structure; a clamping slot 131 is formed in a side wall of the outer shell 13; the inner plug 14 is divided into two parts of structures; one part is a wide structure, and the other part is a narrow structure; a clamping block 141 is arranged on a side wall of the narrow structure of the inner plug 14; the narrow structure of the inner plug 14 extends deep into the outer shell 13 to limit positions of the spring sheet 20 and the conductor sheet 30; the wide structure cooperates with an outer frame of the outer shell 13 to limit an extending distance of the narrow structure; and the clamping block 141 and the clamping slot 131 achieve clamping and fixing to prevent the inner plug 14 from falling off.

For the structural design of the wire plugging hole 12, the wire plugging hole 12 has a guide positioning hole 121 corresponding to the outer shell 13; the guide positioning hole 121 is communicated to the coupling space 11; the number of the guide positioning holes 121 is set according to the number of the wire pressing units 201; first isolation structures 15 are arranged between all the guide positioning holes 121; and the first isolation structures 15 isolate the guide positioning holes 121 from each other, so that each of the plurality of guide positioning holes 121 forms a structure that limits a swing scope of a wire in the guide positioning hole. The wire plugging hole 12 has a square wire guide hole 122 corresponding to the inner plug 14; the square wire guide hole 122 is of a run-through structure, and the square wire guide hole 122 is communicated to the coupling space 11; the number of the square wire guide holes 122 is set according to the number of the wire pressing units 201; second isolation structures 16 are arranged between all the square wire guide holes 122; and the second isolation structures 16 isolate the square wire guide holes 122 from each other.

For the structural design of the coupling space 11, a first wavy structure 132 matched with the shape of the spring sheet 20 is designed at an edge, corresponding to the guide positioning hole 121, in the outer shell 13; and the first wavy structure 132 corresponds to the first bending angle 221, the second bending angle 222 and the third bending angle 223 of the deformable portion 22 in each wire pressing unit 201 of the spring sheet 20. A second wavy structure 142 matched with the shapes of the spring sheet 20 and the conductor sheet 30 is designed at a portion of the inner plug 14 that extends deep into the outer shell 13; the second wavy structure 142 corresponds to the first bending angle 221, the second bending angle 222 and the third bending angle 223 of the deformable portion 22 in each wire pressing unit 201 of the spring sheet 20; and the second wavy structure 142 also corresponds to the bend structure of the conductor sheet 30. A coupling space 11 for accommodating the spring sheet 20 and the conductor sheet 30 is formed between the first wavy structure 132 and the second wavy structure 142.

Referring to FIG. 1 to FIG. 10, when a plurality of wire pressing units 201 are provided, the various wire pressing units 201 may be horizontally connected or perpendicularly connected.

When the wire pressing units 201 are horizontally connected, adjacent wire pressing units 201 are in planar connection through the deformable portions 22 located below the second bending angles 222, thus forming one spring sheet 20 of a horizontally connected structure; the deformable portions 22, located above the second bending angles 222, between adjacent wire pressing units 201 are separated from each other, so as to avoid mutual interference between the plurality of wire pressing units 201; and in the spring sheet 20, a first assembling gap 24 is reserved between planes formed after the third bending angles 223 of the various deformable portions 22 are bent, and is used for mounting the conductor sheet 30.

Connection surfaces for integrally connecting the deformable portions 22 of all the wire pressing units 201 are formed on the deformable portions 22 located above the third bending angles 223; and a space for separation is provided between the connection surfaces and the wire pressing portions 21.

The conductor sheet 30 is bent along the middle part, and a second assembling gap 34 is reserved between the bent planes of the conductor sheet 30 and is used for mounting the spring sheet 20; two ends of the bent conductor sheet 30 are located on the same side; and the tooth-shaped structure 31 is formed at one end of the conductor sheet 30.

One end of the conductor sheet 30 corresponding to the tooth-shaped structure 31 is plugged into the first assembling gap 24, and the number of teeth on the tooth-shaped structure 31 corresponds to the number of the wire pressing units 201; the tooth-shaped structure 31 extends deep into the space for separation between the connection surfaces and the wire pressing portions 21; each tooth on the tooth-shaped structure 31 is restrained between the two deformable portions 22 of the corresponding wire pressing unit 201; and the connection surface is plugged into the second assembling gap 34, so that a structure for mutual hooking cooperation is formed between the conductor sheet 30 and the spring sheet 20.

When the wire pressing units 201 are perpendicularly connected, the third bending angles 223 of the deformable portions 22 are bent to form a perpendicularly connected surface; two perpendicularly adjacent wire pressing units 201 are connected through the perpendicularly connected surface to form one spring sheet 20 of a perpendicularly connected structure, and a third assembling gap 25 is reserved between planes formed after the third bending angles 223 of the deformable portions 22 of two adjacent wire pressing units 201 are bent; and a space for separation is provided between the wire pressing portions 21 of two adjacent wire pressing units 201 and is used for mounting the conductor sheet 30.

The perpendicularly connected surfaces of the two deformable portions 22 on two sides of the wire pressing portion 21 respectively extend towards one side of the wire pressing portion 21 to form one arc bulge portion; and each arc bulge portion is inwards bent to jointly form a supporting surface 26 of an inner bend angle of the conductor sheet 30.

The conductor sheet 30 is bent along the middle part, and a fourth assembling gap 35 cooperating with the supporting surface 26 is reserved between the bent planes of the conductor sheet 30; two ends of the bent conductor sheet 30 are located on the same side; and the tooth-shaped structure 31 is formed at two ends of the conductor sheet 30.

The two ends of the conductor sheet 30 are plugged into the third assembling gap 25, and the two ends of the conductor sheet 30 respectively resist against the third bending angles 223 of two adjacent wire pressing units 201; the number of teeth on the tooth-shaped structure 31 corresponds to the number of the wire pressing units 201; the tooth-shaped structure 31 extends deep into the space between two adjacent wire pressing portions 21; each tooth on the tooth-shaped structure 31 is restrained between the two perpendicularly connected surfaces of the two adjacent wire pressing units 201; at the same time, the supporting surface 26 extends deep into the fourth assembling gap 35; and the supporting surface 26 resists against an inner edged surface of the conductor sheet 30.

Practically, the self-coupled wire connector is configured to be a structure with a plurality of wire plugging holes 12, and the plurality of wire plugging holes 12 are isolated from each other, so that a space where a wire moves inside the wire plugging hole is restrained, and the instability of contact caused by wire swinging is reduced. In order to meet requirements of products of different specifications, a further description will be made below from two embodiments:

Embodiment 1

Referring to FIG. 1 to FIG. 5, a plurality of wire pressing units 201 are provided on the spring sheet 20, and the plurality of wire pressing units 201 are configured to be a horizontally connected structure. A plurality of wire plugging holes 12 correspond to the plurality of wire pressing units 201 on a one-to-one basis. By this structural design, three wire plugging holes 12 are taken as an example, which can satisfy a wire connector with an odd number of wire plugging holes 12. Specifically, the plurality of wire pressing units 201 are arranged into one row. Two adjacent wire pressing units 201 are integrally combined through one deformable portion 22, so that the plurality of wire pressing units 201 can be integrally formed. In addition, in the chip 20, a first assembling gap 24 is reserved between planes after the third bending angles 223 of the deformable portions 22 are bent. The conductor sheet 30 is bent along the middle part, so that a second assembling gap 34 is reserved between the bent planes of the conductor sheet 30. The conductor sheet 30 is plugged into the first assembling gap 24 through the end correspondingly provided with the tooth-shaped structure 31. The number of teeth on the tooth-shaped structure 31 corresponds to the number of the wire pressing units 201. The tooth-shaped structure 31 extends deep into the space for separation between the connection surfaces and the wire pressing portions 21; each tooth on the tooth-shaped structure 31 is restrained between the two deformable portions 22 of the corresponding wire pressing unit 201; and the connection surface is plugged into the second assembling gap 34, so that a structure for mutual hooking cooperation is formed between the conductor sheet 30 and the spring sheet 20.

Embodiment 2

Referring to FIG. 6 to FIG. 10, a plurality of wire pressing units 201 are provided on the spring sheet 20, and the plurality of wire pressing units 201 are arranged into two rows. A perpendicularly connected structure is arranged between the two rows of wire pressing units 201. Each row of wire pressing units 201 are configured to be a horizontally connected structure. The third bending angles 223 of the deformable portions 22 are bent to form a perpendicularly connected surface; two perpendicularly adjacent wire pressing units 201 are combined through the perpendicularly connected surface, and a third assembling gap 25 is reserved between planes formed after the third bending angles 223 of the deformable portions 22 of two adjacent wire pressing units 201 are bent; the perpendicularly connected surfaces of the two deformable portions 22 on two sides of the wire pressing portion 21 respectively extend towards one side of the wire pressing portion 21 to form one arc bulge portion; and each arc bulge portion is inwards bent to jointly form a supporting surface 26 of an inner bend angle of the conductor sheet 30. The conductor sheet 30 is bent along the middle part, and a fourth assembling gap 35 cooperating with the supporting surface 26 is reserved between the bent planes of the conductor sheet 30; two ends of the bent conductor sheet 30 are located on the same side; the tooth-shaped structure 31 is formed at two ends of the conductor sheet 30; the two ends of the conductor sheet 30 are plugged into the third assembling gap 25, and the two ends of the conductor sheet 30 respectively resist against the third bending angles 223 of two adjacent wire pressing units 201; the number of teeth on the tooth-shaped structure 31 corresponds to the number of the wire pressing units 201; the tooth-shaped structure 31 extends deep into the space between two adjacent wire pressing portions 21; each tooth on the tooth-shaped structure 31 is restrained between the two perpendicularly connected surfaces of the two adjacent wire pressing units 201; at the same time, the supporting surface 26 extends deep into the fourth assembling gap 35; and the supporting surface 26 resists against an inner edged surface of the conductor sheet 30.

For those skilled in the art, it is apparent that the present disclosure is not limited to the details of the demonstrative embodiments mentioned above, and that the present disclosure can be realized in other specific forms without departing from the spirit or basic features of the present disclosure. Therefore, from any point of view, the embodiments should be regarded as exemplary and non-limiting. The scope of the present disclosure is defined by the appended claims rather than the above description. Therefore, all changes falling within the meanings and scope of equivalent elements of the claims are intended to be included in the present disclosure.

What is claimed is:

1. A self-coupled wire connector using a bend spring sheet and conductor sheet, comprising a main body, a spring sheet and a conductor sheet, wherein a coupling space for accommodating the spring sheet and the conductor sheet is formed inside the main body; a wire plugging hole passing through the coupling space is formed in the main body; the spring sheet and the conductor sheet are assembled in the coupling space, and are kept in a self-coupling state through the coupling space;

the spring sheet is provided with one or more wire pressing units; each wire pressing unit comprises a middle wire pressing portion and two deformable portions respectively located on two sides of the wire pressing portion; the wire pressing portion and the deformable portions are integrated at upper parts; the deformable portions resist against the inside of the coupling space and correspond to two sides of the wire plugging hole, so that a lower part of the wire pressing portion moves between the wire plugging holes; when a plurality of wire pressing units are provided, tear structures for avoiding mutual interference are arranged between the plurality of wire pressing units;

the conductor sheet is designed to be a bend structure resisting against the deformable portions; a tooth-shaped structure passing through a space between the two deformable portions is formed at an end part of the conductor sheet resisting against the deformable portions; and the tooth-shaped structure extends deep into the wire plugging hole, so that the tooth-shaped structure and the wire pressing portion cooperate with each other to form a coupling gap for clamping a wire end.

2. The self-coupled wire connector using the bend spring sheet and conductor sheet according to claim 1, wherein an upper first bending angle, a middle second bending angle and a lower third bending angle are arranged on each deformable portion; and the first bending angle, the second bending angle and the third bending angle jointly form the deformable portion of a wavy structure.

3. The self-coupled wire connector using the bend spring sheet and conductor sheet according to claim 2, wherein when a plurality of wire pressing units are provided, the various wire pressing units may be horizontally connected or perpendicularly connected.

4. The self-coupled wire connector using the bend spring sheet and conductor sheet according to claim 3, wherein when the wire pressing units are horizontally connected, adjacent wire pressing units are in planar connection through the deformable portions located below the second bending angles, thus forming one spring sheet of a horizontally connected structure; the deformable portions, located above the second bending angles, between adjacent wire pressing units are separated from each other, so as to avoid mutual interference between the plurality of wire pressing units; and in the spring sheet, a first assembling gap is reserved between planes formed after the third bending angles of the various deformable portions are bent, and is used for mounting the conductor sheet.

5. The self-coupled wire connector using the bend spring sheet and conductor sheet according to claim 3, wherein when the wire pressing units are horizontally connected, connection surfaces for integrally connecting the deformable portions of all the wire pressing units are formed on the deformable portions located above the third bending angles; and a space for separation is provided between the connection surfaces and the wire pressing portions.

6. The self-coupled wire connector using the bend spring sheet and conductor sheet according to claim 3, wherein when the wire pressing units are horizontally connected, the conductor sheet is bent along the middle part, and a second assembling gap is reserved between the bent planes of the conductor sheet and is used for mounting the spring sheet; two ends of the bent conductor sheet are located on the same side; and the tooth-shaped structure is formed at one end of the conductor sheet.

7. The self-coupled wire connector using the bend spring sheet and conductor sheet according to claim 3, wherein when the wire pressing units are horizontally connected, adjacent wire pressing units are in planar connection through the deformable portions located below the second bending angles, thus forming one spring sheet of a horizontally connected structure; the deformable portions, located above the second bending angles, between the adjacent wire pressing units are separated from each other to avoid mutual interference between the plurality of wire pressing units; in the spring sheet, a first assembling gap is reserved between planes formed after the third bending angles of the various deformable portions are bent, and is used for mounting the conductor sheet; connection surfaces for integrally connecting the deformable portions of all the wire pressing units are formed on the deformable portions located above the third bending angles; a space for separation is provided between the connection surfaces and the wire pressing portions; the conductor sheet is bent along the middle part, and a second assembling gap is reserved between the bent planes of the conductor sheet and is used for mounting the spring sheet; two ends of the bent conductor sheet are located on the same side; the tooth-shaped structure is formed at one end of the conductor sheet;

one end of the conductor sheet corresponding to the tooth-shaped structure is plugged into the first assembling gap, and the number of teeth on the tooth-shaped structure corresponds to the number of the wire pressing units; the tooth-shaped structure extends deep into the space for separation between the connection surfaces and the wire pressing portions; each tooth on the tooth-shaped structure is restrained between the two deformable portions of the corresponding wire pressing unit; and the connection surface is plugged into the second assembling gap, so that a structure for mutual hooking cooperation is formed between the conductor sheet and the spring sheet.

8. The self-coupled wire connector using the bend spring sheet and conductor sheet according to claim 3, wherein when the wire pressing units are perpendicularly connected, the third bending angles of the deformable portions are bent to form a perpendicularly connected surface; two perpendicularly adjacent wire pressing units are connected through the perpendicularly connected surface to form one spring sheet of a perpendicularly connected structure, and a third assembling gap is reserved between planes formed after the third bending angles of the deformable portions of two adjacent wire pressing units are bent; a space for separation is provided between the wire pressing portions of two adjacent wire pressing units and is used for mounting the conductor sheet.

9. The self-coupled wire connector using the bend spring sheet and conductor sheet according to claim 3, wherein when the wire pressing units are perpendicularly connected, the perpendicularly connected surfaces of the two deformable portions on two sides of the wire pressing portion respectively extend towards one side of the wire pressing portion to form one arc bulge portion; and each arc bulge portion is inwards bent to jointly form a supporting surface of an inner bend angle of the conductor sheet.

10. The self-coupled wire connector using the bend spring sheet and conductor sheet according to claim 3, wherein when the wire pressing units are perpendicularly connected, the conductor sheet is bent along the middle part, and a fourth assembling gap cooperating with the supporting surface is reserved between the bent planes of the conductor sheet; two ends of the bent conductor sheet are located on the same side; and the tooth-shaped structure is formed at two ends of the conductor sheet.

11. The self-coupled wire connector using the bend spring sheet and conductor sheet according to claim 3, wherein when the wire pressing units are perpendicularly connected, the third bending angles of the deformable portions are bent to form a perpendicularly connected surface; two perpendicularly adjacent wire pressing units are connected through the perpendicularly connected surface to form one spring sheet of a perpendicularly connected structure, and a third assembling gap is reserved between planes formed after the third bending angles of the deformable portions of two adjacent wire pressing units are bent; a space for separation is provided between the wire pressing portions of two adjacent wire pressing units and is used for mounting the conductor sheet; the perpendicularly connected surfaces of the two deformable portions on two sides of the wire pressing portion respectively extend towards one side of the wire pressing portion to form one arc bulge portion; each arc bulge portion is inwards bent to jointly form a supporting surface of an inner bend angle of the conductor sheet; the conductor sheet is bent along the middle part, and a fourth assembling gap cooperating with the supporting surface is reserved between the bent planes of the conductor sheet; two ends of the bent conductor sheet are located on the same side; the tooth-shaped structure is formed at two ends of the conductor sheet;

the two ends of the conductor sheet are plugged into the third assembling gap, and the two ends of the conductor sheet respectively resist against the third bending angles of two adjacent wire pressing units; the number of teeth on the tooth-shaped structure corresponds to the number of the wire pressing units; the tooth-shaped structure extends deep into the space between two adjacent wire pressing portions; each tooth on the tooth-shaped structure is restrained between the two perpendicularly connected surfaces of the two adjacent wire pressing units; at the same time, the supporting surface extends deep into the fourth assembling gap; and the supporting surface resists against an inner edged surface of the conductor sheet.

12. The self-coupled wire connector using the bend spring sheet and conductor sheet according to claim 1, wherein the main body comprises an outer shell and an inner plug plugged to the outer shell; a coupling space is correspondingly formed between the outer shell and the inner plug; and the wire plugging hole penetrates through the inner plug and extends into the outer shell.

13. The self-coupled wire connector using the bend spring sheet and conductor sheet according to claim 12, wherein the outer shell is of uni-directional opened structure, and a clamping slot is formed in a side wall of the outer shell.

14. The self-coupled wire connector using the bend spring sheet and conductor sheet according to claim 12, wherein a clamping block is arranged on a side wall of the inner plug; the inner plug is divided into two parts of structures; one part is a wide structure; and the other part is a narrow structure.

15. The self-coupled wire connector using the bend spring sheet and conductor sheet according to claim 12, wherein the outer shell is of a uni-directional opened structure; a clamping slot is formed in a side wall of the outer shell; the inner plug is divided into two parts of structures; one part is a wide structure, and the other part is a narrow structure; a clamping block is arranged on a side wall of the narrow structure of the inner plug; the narrow structure of the inner plug extends deep into the outer shell to limit positions of the spring sheet and the conductor sheet; the wide structure cooperates with an outer frame of the outer shell to limit an extending distance of the narrow structure; and the clamping block and the clamping slot achieve clamping and fixing to prevent the inner plug from falling off.

16. The self-coupled wire connector using the bend spring sheet and conductor sheet according to claim 12, wherein the wire plugging hole has a guide positioning hole corresponding to the outer shell; the guide positioning hole is communicated to the coupling space; the number of the guide positioning holes is set according to the number of the wire pressing units; first isolation structures are arranged between all the guide positioning holes; the first isolation structures isolate the guide positioning holes from each other, so that each of the plurality of guide positioning holes forms a structure that limits a swing scope of a wire in the guide positioning hole.

17. The self-coupled wire connector using the bend spring sheet and conductor sheet according to claim 12, wherein the wire plugging hole has a square wire guide hole corresponding to the inner plug; the square wire guide hole is of a run-through structure, and the square wire guide hole is communicated to the coupling space; the number of the square wire guide holes is set according to the number of the wire pressing units; second isolation structures are arranged between all the square wire guide holes; and the second isolation structures isolate the square wire guide holes from each other.

18. The self-coupled wire connector using the bend spring sheet and conductor sheet according to claim 2, wherein the main body comprises an outer shell and an inner plug plugged to the outer shell; a coupling space is correspondingly formed between the outer shell and the inner plug; the wire plugging hole penetrates through the inner plug and extends into the outer shell; the wire plugging hole has a guide positioning hole corresponding to the outer shell; the wire plugging hole has a square wire guide hole corresponding to the inner plug; the guide positioning hole and the square wire guide hole are both communicated with the coupling space; the guide positioning hole corresponds to the square wire guide hole; a first wavy structure matched with the shape of the spring sheet is designed at an edge, corresponding to the guide positioning hole, in the outer shell; and the first wavy structure corresponds to the first bending angle, the second bending angle and the third bending angle of the deformable portion in each wire pressing unit of the spring sheet.

19. The self-coupled wire connector using the bend spring sheet and conductor sheet according to claim 2, wherein the main body comprises an outer shell and an inner plug plugged to the outer shell; a coupling space is correspondingly formed between the outer shell and the inner plug; the wire plugging hole penetrates through the inner plug and extends into the outer shell; the wire plugging hole has a guide positioning hole corresponding to the outer shell part; the wire plugging hole has a square wire guide hole corresponding to the inner plug; the guide positioning hole and the square wire guide hole are both communicated with the coupling space; the guide positioning hole corresponds to the square wire guide hole; a second wavy structure matched with the shapes of the spring sheet and the conductor sheet is designed at a portion of the inner plug that extends deep into the outer shell; the second wavy structure corresponds to the first bending angle, the second bending angle and the third bending angle of the deformable portion in each wire pressing unit of the spring sheet; and the second wavy structure also corresponds to the bend structure of the conductor sheet.

20. The self-coupled wire connector using the bend spring sheet and conductor sheet according to claim 2, wherein the main body comprises an outer shell and an inner plug plugged to the outer shell; a first wavy structure matched with the shape of the spring sheet is designed at an edge, corresponding to a guide positioning hole, in the outer shell; a second wavy structure matched with the shapes of the spring sheet and the conductor sheet is designed at a portion of the inner plug that extends deep into the outer shell; and a coupling space for accommodating the spring sheet and the conductor sheet is formed between the first wavy structure and the second wavy structure.

* * * * *